US005700329A

United States Patent [19]

Edwards et al.

[11] Patent Number: 5,700,329

[45] Date of Patent: Dec. 23, 1997

[54] FILTER STANDPIPE FOR DISHWASHER

[75] Inventors: James M. Edwards, Kinston; John E. Dries, Goldsboro, both of N.C.

[73] Assignee: White Consolidated Industries, Inc., Cleveland, Ohio

[21] Appl. No.: 653,942

[22] Filed: May 22, 1996

[51] Int. Cl.[6] ..... B08B 3/02

[52] U.S. Cl. ..... 134/10; 134/155; 134/186; 134/111

[58] Field of Search ..... 134/111, 110, 134/109, 155, 186, 577

[56] References Cited

U.S. PATENT DOCUMENTS

| | | | |
|---|---|---|---|
| 1,225,416 | 3/1917 | Khotinsky | 137/577 |
| 2,679,253 | 5/1954 | Carson . | |
| 2,788,010 | 4/1957 | Glassey et al. . | |
| 2,830,604 | 4/1958 | Sherman, Jr. . | |
| 2,891,574 | 6/1959 | Dahlberg | 137/577 |
| 3,108,607 | 10/1963 | Blakeslee . | |
| 3,266,518 | 8/1966 | Erickson et al. | 135/577 |
| 3,646,961 | 3/1972 | Marquardson | 137/577 |
| 3,669,132 | 6/1972 | Mamrose . | |
| 4,125,020 | 11/1978 | McClure . | |
| 4,883,602 | 11/1989 | Anderson . | |
| 4,969,479 | 11/1990 | Lagerstrand | 134/111 |
| 5,097,855 | 3/1992 | Martinsson et al. . | |
| 5,333,631 | 8/1994 | Kirkland et al. . | |

FOREIGN PATENT DOCUMENTS

| | | | |
|---|---|---|---|
| 2556480 | 6/1977 | Germany | 134/104.1 |
| 2614949 | 10/1977 | Germany | 134/111 |
| 2656556 | 6/1978 | Germany | 134/111 |
| 3723721 | 5/1988 | Germany | 134/104.1 |

*Primary Examiner*—Frankie L. Stinson

*Attorney, Agent, or Firm*—Pearne, Gordon, McCoy & Granger LLP

[57] ABSTRACT

Disclosed is a filter standpipe for a dishwasher filter and sump unit that prevents loss of circulation pump prime due to filter blockage. The filter standpipe preferably comprises a weir tube that projects upwards from the upper surface of the filter to provide a bypass for wash water trapped on the upper surface of a blocked filter.

13 Claims, 7 Drawing Sheets

FILTER STANDPIPE FOR DISHWASHER

FIELD OF THE INVENTION

The present invention relates to a standpipe that extends above the top surface of a filter and circulation pump inlet disposed in the lower region of a dishwasher. The standpipe provides a bypass for flow of wash water through the filter to the pump inlet in the event the filter becomes blocked.

BACKGROUND OF THE INVENTION

Dishwashers generally comprise a sump and a circulation pump that collect, pump, and circulate wash water within a washing chamber in the dishwasher. One or more filters are often provided in the sump and/or at the pump inlet to prevent food particles or other objects from entering the pump housing, and particularly the region adjacent the pump impeller. These filters are typically flat screens that reside over the sump unit and pump inlet.

Dishwasher filters can become clogged or plugged with food particles that collect on the filter as wash water drains through the filter into the sump unit below. This is undesirable since a blocked filter may cause an excessive amount of wash water to accumulate on the filter and not return to the sump. As a result, artisans have devised various techniques to remedy a blocked filter condition. One approach has been to spray the blocked side of the filter with pressurized wash water from a spray arm disposed above the filter. Further details in this regard are provided in U.S. Pat. No. 5,333,631 and British Patent 2,204,482, both of which are herein incorporated by reference. Generally, such pressurized sprays do sufficiently remove food debris from the filter to thereby enable wash water to drain through the filter and alleviate the previous plugged filter condition.

Although satisfactory in most respects, this technique requires that the circulation pump provide wash water to the spray arm. It has been found that in severe cases of filter blockage, the supply of wash water to the pump and thus to the spray arm is impeded and in many instances is entirely suppressed. Accordingly, the filter remains plugged until manually cleaned and the pump restarted.

Thus, there is a need for a dishwasher design and technique that overcome the problem of stoppage of wash water flow to filter sprays resulting from filter blockage.

SUMMARY OF THE INVENTION

The present invention provides a dishwasher sump unit that overcomes the aforementioned problems by use of a filter standpipe that provides a bypass for flow of wash water around a blocked filter. The invention provides a dishwasher sump unit comprising a sump container, a circulation pump, a filter disposed between the sump container and the inlet to the pump, and a filter standpipe located in the flow path to the pump, parallel to the filter.

In particular, the invention provides a sump enclosure having an upper region defining an opening that enables access to the interior of the enclosure, a filter extending across the opening, and a filter standpipe having one end located along one side of the filter and a second end located along another oppositely directed side of the filter.

Specifically, the invention provides a sump enclosure defining an interior cavity for receiving and storing wash water; an annular-shaped filter that is preferably centrally located with respect to the enclosure and configured so that it radially slopes downward toward the center of the enclosure, the filter having a first upward facing exposed face and a second oppositely directed face; a circulation pump generally disposed below the filter, the pump having an inlet and an outlet; a rotatable spray arm in fluid communication with the pump outlet, the spray arm disposed above the filter; and a filter standpipe extending from the first face of the filter to the second face of the filter.

The invention encompasses a wide array of configurations for the filter standpipe such as providing a flat upper distal edge over which wash water may flow, an irregular edge providing for different rates of flow through the standpipe depending upon the height of the wash water, and the use of various accessories such as a bell cap positioned over the uppermost end of the standpipe.

The present invention also provides a dishwasher utilizing a sump unit comprising the filter standpipe.

DESCRIPTION OF THE PREFERRED EMBODIMENTS

Figure 1:
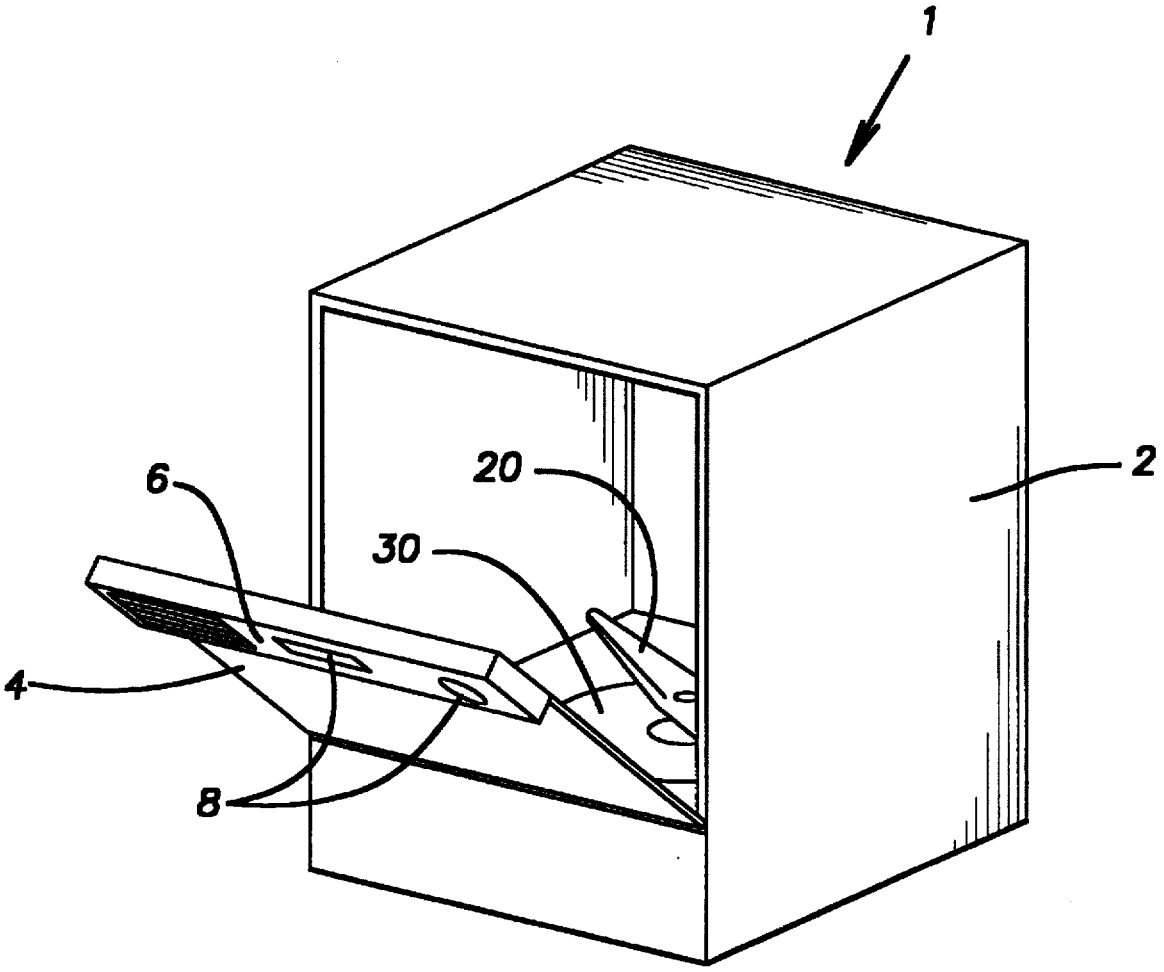
FIG. 1 is a perspective view of a dishwasher comprising a lower spray arm and sump unit within the interior washing chamber.

FIG. 1 illustrates a dishwasher 1 generally comprising an enclosure 2 that houses an interior chamber for receiving and accommodating dishes or other tableware to be washed therein, a pivotally attached front door 4, and a control panel 6 containing one or more controls or indicating lights 8 as known in the art. Disposed within the lower region of the interior chamber of the dishwasher 1 is a spray arm 20, a filter 30, and a sump unit 10 (not shown in FIG. 1). The filter 30 is a relatively flat annular-shaped screen that resides over the sump unit 10.

Figure 2:
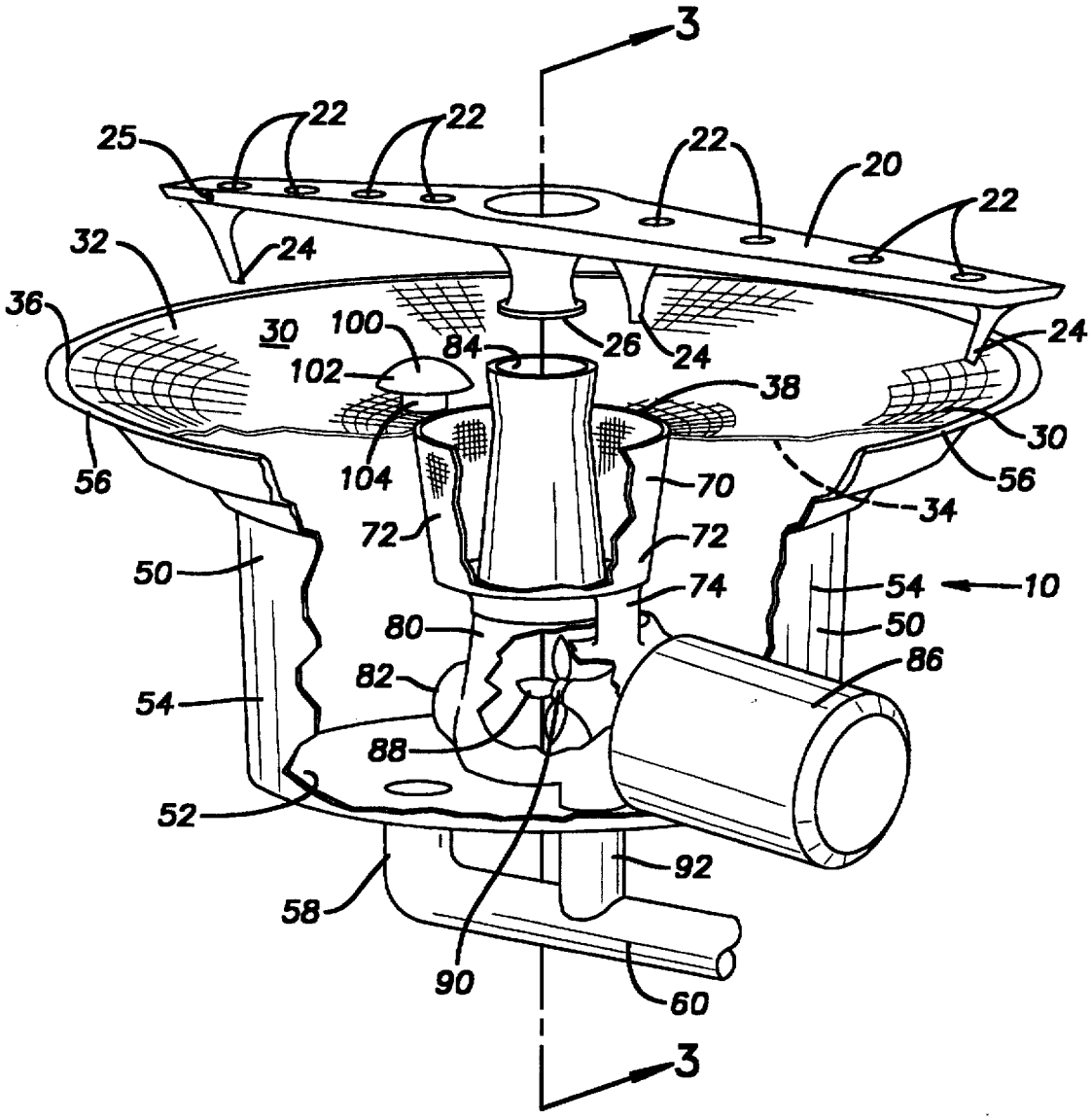
FIG. 2 is a fragmentary partially exploded view illustrating in greater detail the spray arm and lower sump unit of the dishwasher depicted in FIG. 1.

FIG. 2 illustrates in greater detail the spray arm 20 and sump unit 10 utilized in the dishwasher 1 depicted in FIG. 1. The sump unit 10 generally comprises a sump enclosure 50 having the filter 30 preferably disposed over a top opening of the enclosure 50, a circulation pump 86 having an inlet 82, an outlet 84, and a master drain 60. The circulation pump 86 delivers wash water drawn through the inlet 82 and a pump housing 80 to the spray arm 20 in fluid communication with the pump outlet 84. The sump unit 10 further comprises a soil director 70 disposed within the interior of the enclosure 50. The sump enclosure 50 is typically a cylindrical container, comprising a sump sidewall 54 and a sump bottom wall 52. Provided along the bottom wall 52 is a sump drain 58 described in greater detail below, that is in fluid communication with the master drain 60.

The filter 30 provides an upper filter surface 32 and an oppositely facing lower surface 34. The filter 30 is supported along its outer circumferential edge 36 by a sump filter support surface 56 extending around the upper perimeter of the enclosure 50, and is further supported along its inner edge 38 by the upper periphery of a filter wall 72 of the soil director 70. The soil director 70 is typically in the form of a cup-like basket filter disposed within the sump unit 10 at a location suitable to receive food particles and other debris collected on the upper surface 32 of the filter 30. As illustrated in FIG. 2, the soil director 70 is radially disposed around the pump outlet 84 and provides a soil director drain tube 74 extending from the director 70 to the pump housing 80.

The spray arm 20 is disposed at or near the pump outlet 84 and mounted so that it can freely rotate in a horizontal plane above the filter 30 and sump unit 10. One or more bearing surfaces 26 may be provided between the spray arm 20 and pump outlet 84 to facilitate rotation of the spray arm 20. The spray arm is hollow and provides one or more interior channels or passages for directing wash water exiting the pump outlet 84 to a plurality of spray nozzles 22 provided along an upper surface of the arm 20. Each spray nozzle 22 directs a stream of wash water from the pump outlet 84 upwards to the dishes or tableware within the dishwasher 1 during cleaning or rinsing cycles. Also provided on the spray arm 20 are a plurality of spray jets 24 that spray wash water onto the upper surface 32 of the filter 30. Preferably, the outermost spray jets 24 disposed at the periphery of the arm 20 eject wash water toward the center of the filter 30 to direct particles of food or other debris disposed upon the upper surface 32 of the filter 30 into the soil director 70. As is known in the art, the spray arm 20 typically comprises one or more spray jets 25 disposed on the sides of the arm. When pressurized wash water is ejected from the jets 25, the spray arm rotates at bearing surface 26.

As further illustrated in FIG. 2, typically, the filter 30 is oriented with respect to the sump enclosure 50 and the soil director 70 such that the outer filter edge 36 is positioned at a greater height from the sump bottom wall 52 than the inner filter edge 38. The resulting radially and downwardly sloping configuration of filter 30 facilitates the washing of food particles or debris on the upper filter surface 32 toward the soil director 70 by spray jets 24.

During operation of the dishwasher 1, food particles collected on the upper surface 32 of the filter are transferred to the soil director 70 by action of the spray jets 24, and are further directed through the soil director drain tube 74 into a collection chamber within the pump housing 80. Once in this chamber, the particles are masticated or otherwise ground by one or more rotating blades 88 disposed about the pump shaft 90. The chopped or ground food particles exit the pump housing 80 through a pump drain 92 and into the master drain 60.

Wash water from the dishwasher interior and that which is sprayed onto the filter 30 by the spray jets 24 passes through the filter 30 and into the sump enclosure 50. Wash water collects within the enclosure 50 and is recirculated within the dishwasher interior via the spray arm 20 and the pump 86. If the filter becomes plugged or blocked, for reasons described below, the supply of wash water to the spray arm 20 can be impeded or even stopped. In that event, the flow of wash water to the jets 24 of the spray arm 20 is suppressed and so, the debris on the filter 30 is not removed and the blocked filter condition is not remedied. If filter blockage is significant and not remedied during dishwasher operation, the circulation pump 86 can lose its prime thereby resulting in termination of wash water flow.

During normal washing operation the filter 30 often becomes clogged or partially blocked by food particles, waste, debris, or other objects collected on the upper surface 32 of the filter 30 such that if not remedied, the water level within the sump enclosure 50 drops below the pump inlet 82, thereby allowing air to enter the pump 86 leading to loss of pump prime. When the pump prime is lost, the flow of water through the spray arm 20 and thus through the jets 24 ceases. Accordingly, without any wash water sprays passing over the upper surface 32 of the filter 30, the debris or food particles remain collected on the filter 30, and the filter blockage condition is not remedied.

In accordance with the present invention, a filter standpipe 100 is disposed above the upper surface 32 of the filter 30. The filter standpipe 100 provides a bypass for flow of wash water through the blocked filter 30 and into the sump enclosure 50 so that the liquid level within the enclosure 50 is maintained above the pump inlet 82 and the pump prime is maintained. The filter standpipe 100 also reverses a blocked filter condition so that the level of wash water is restored above the pump inlet 82 and pump prime returned. Details of this phenomenon and the solution provided by the present invention are as follows.

Figure 3:
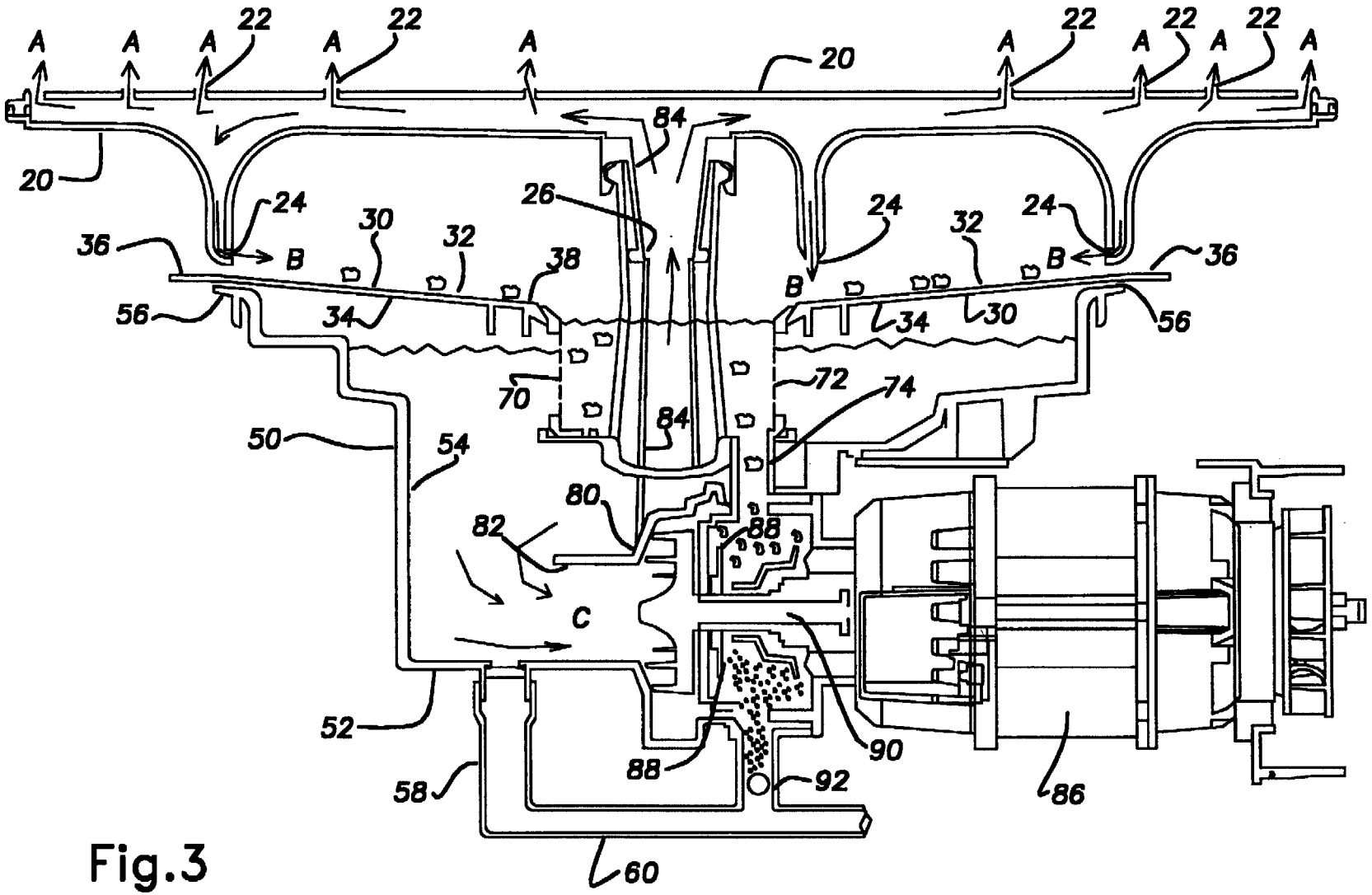
FIG. 3 is a cross-sectional view of the sump unit depicted in FIG. 2 taken along line 3—3, the sump unit having the spray arm mounted to the assembly, illustrating a typical flow of wash water during normal operation of the dishwasher sump unit and spray arm.

Referring to FIG. 3, during normal operation or under light soil conditions, food particles from dishes or tableware disposed in the dishwasher 1 collect on the upper surface 32 of the filter 30. The pump 86 directs wash water upwards through the pump outlet 84 and into the spray arm 20. A portion of the wash water, under pressure, exits the wash arm 20 through the plurality of spray nozzles 22 and illustrated as flowstream A. Pressurized wash water also exits the spray arm 20 through the plurality of spray jets 24 and 25. A portion of the wash water from the spray jets 24 flows across the upper surface 32 of the filter 30 as flowstream B wherein it then drains into the sump enclosure 50 through the soil director filter wall 72 and eventually enters the pump inlet 82 as shown by flowstream C. The remaining portion of the wash water from jets 24 flows through the filter 30 and into the sump enclosure 50. Under these light soil conditions, the total flow capacity of wash water through the filter 30 and filter wall 72 is greater than or equal to the flow demand of the pump 86 at inlet 82. Typically, most dishwasher circulation pumps require an inlet flow rate of about 12 to 13 gallons per minute. And so, to sustain circulation of wash water within the interior of the dishwasher, the flow capacity of the filter 30 and filter wall 72 must be at least from about 12 to about 13 gallons per minute.

Figure 4:
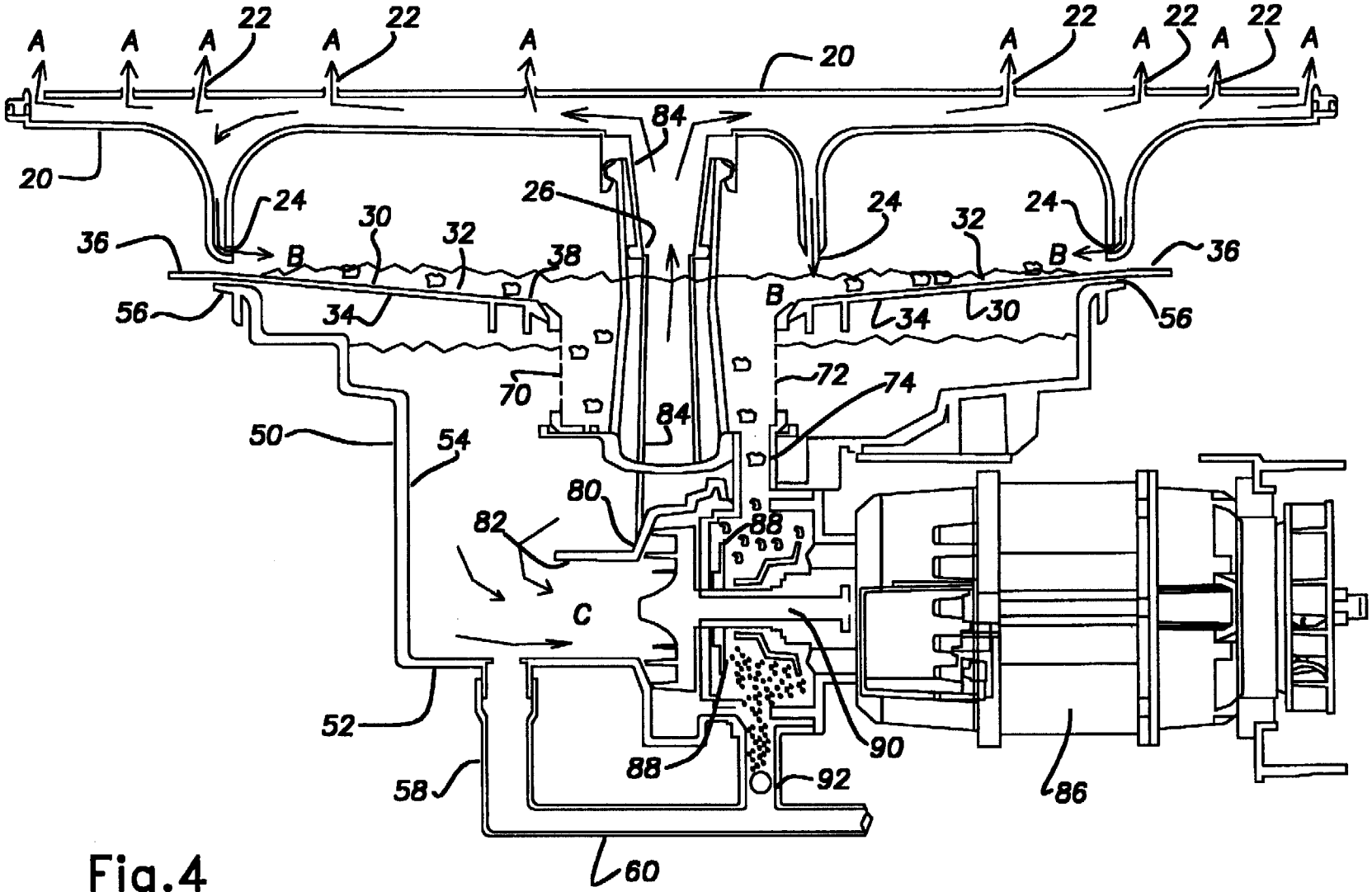
FIG. 4 illustrates operation of the sump unit and spray arm under conditions of heavy loading of a filter screen disposed above the sump unit.

FIG. 4 illustrates dishwasher operation under relatively high soil conditions such that the filter 30 becomes partially blocked by food particles or other debris. The quantity or amount of food particles collected on the filter 30, is such that the particles partially or entirely block the flow of wash water through the filter 30. In this condition, the total flow of wash water through the filter 30 and filter wall 72 into the enclosure 50 is less than the demand of the pump 86. Accordingly, the level of wash water within the enclosure 50 decreases and the level of wash water above the upper surface 32 of the filter 30 increases. If not remedied, the wash water level within the enclosure 50 can drop below the pump inlet 82 and air can then enter the pump housing 80. As explained, entry of air into the pump inlet 82 instead of wash water results in loss of pump prime and stoppage of wash water flow through the spray arm 20.

Figure 5:
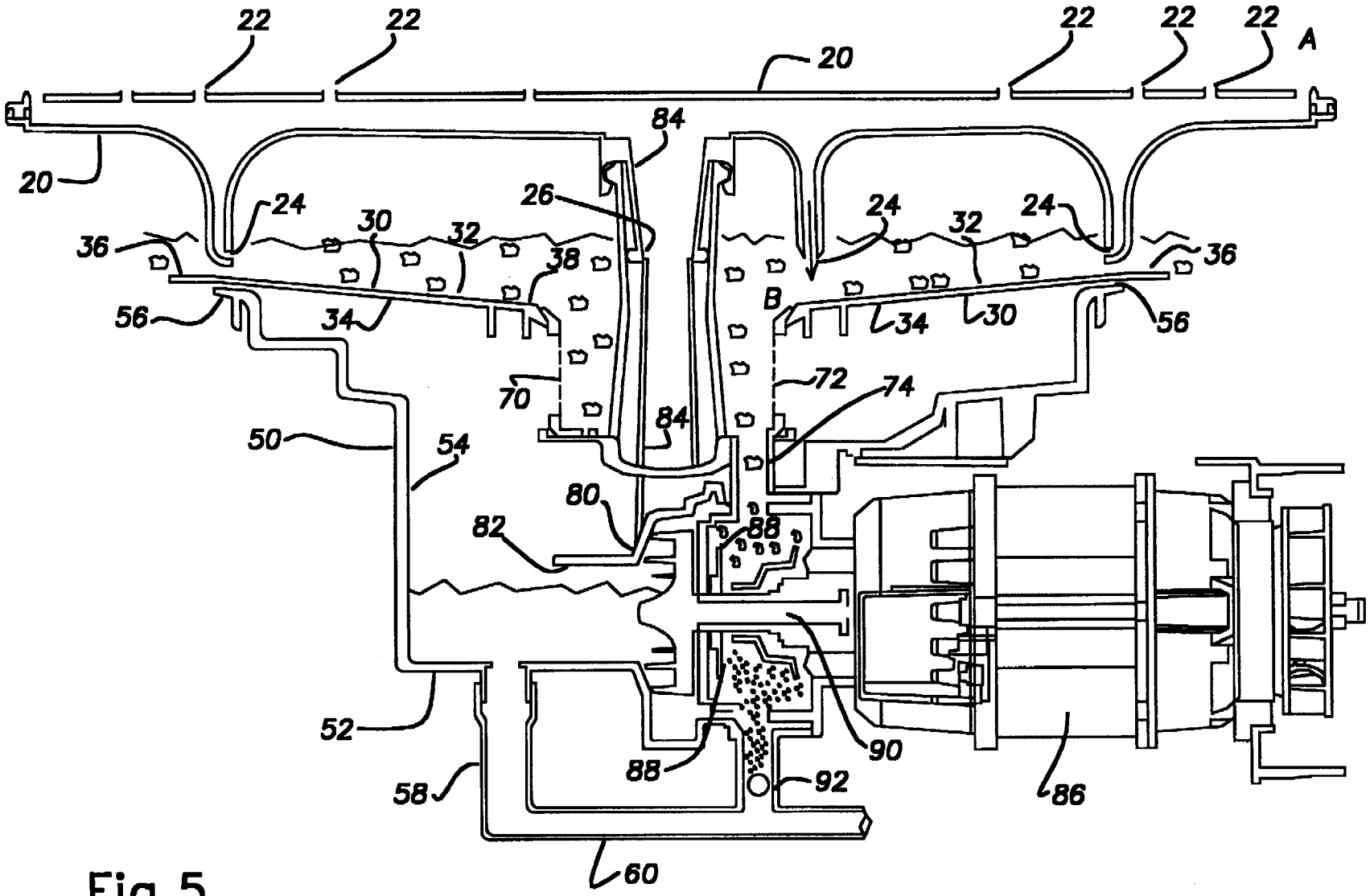
FIG. 5 illustrates filter blockage under conditions of heavy loading leading to loss of pump prime.

FIG. 5 illustrates a condition in which the filter 30 is entirely blocked or substantially so, such that no or minimal wash water can flow through the filter 30. In this condition, the wash water level within the enclosure 50 rapidly drops below the pump inlet 82 and air is allowed to enter the pump housing 80. As a result, the pump prime is lost and circulation of wash water ceases.

Figure 6:
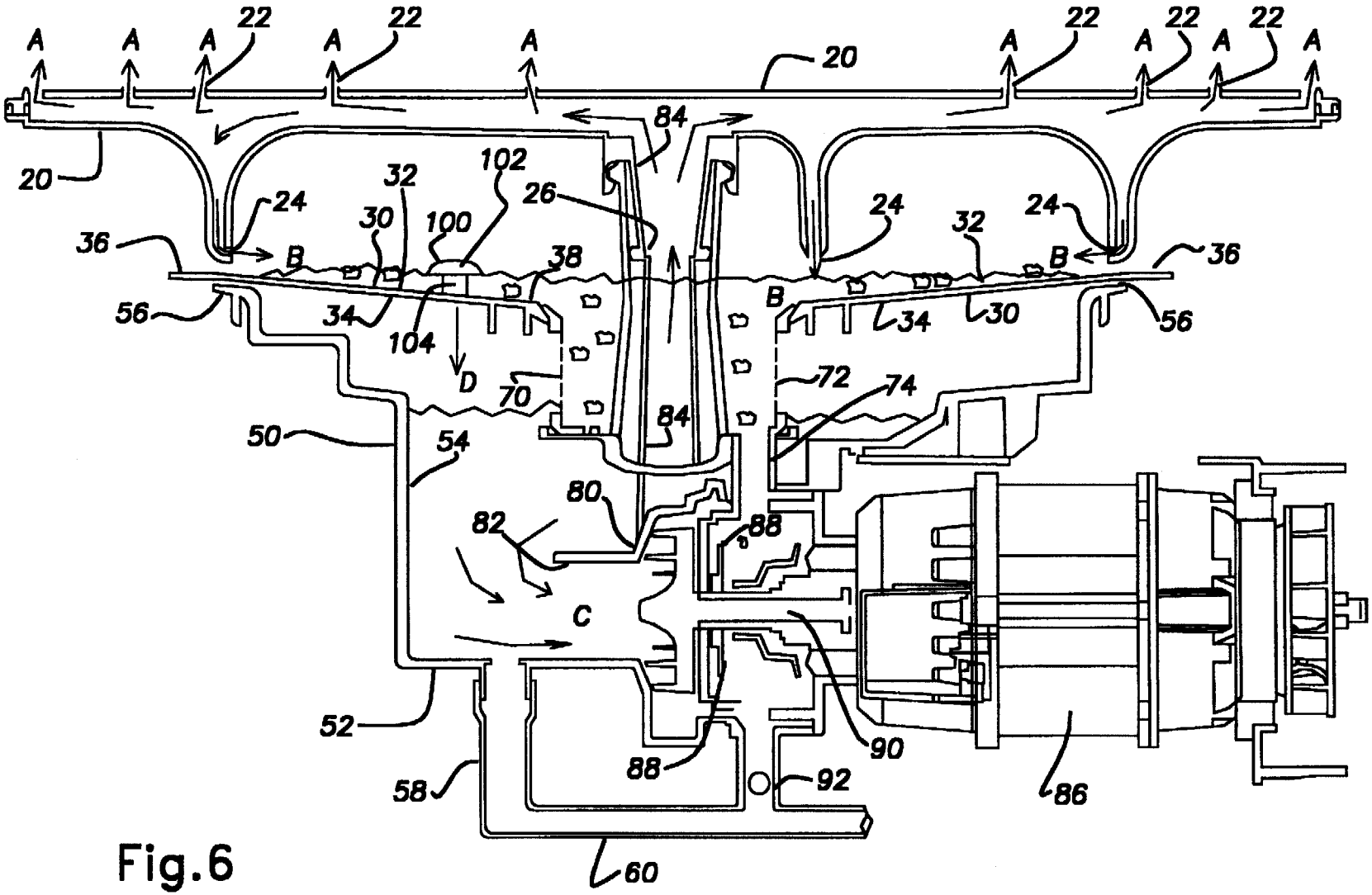
FIG. 6 illustrates a filter and dishwasher sump unit utilizing a filter standpipe in accordance with the present invention.

FIG. 6 illustrates the previously described dishwasher sump unit 10 and spray arm 20 comprising a filter standpipe 100 in accordance with the present invention. The filter standpipe 100 provides a bypass for flow of wash water through the filter 30 illustrated as flowstream D, to thereby maintain the flow of wash water into the enclosure 50. This ensures that the level of wash water therein does not fall below the pump inlet 82. Loss of pump prime is thus avoided.

The standpipe of the present invention is generally a pipe or other tubular or cylindrical member that is oriented with respect to the filter 30 first end it has a first end disposed above the upper surface 32 of the filter and a second end disposed below the lower surface 34 of the filter. The standpipe 100 preferably projects upwards above at least a portion of the upper surface 32 of the filter 30.

For dishwashers utilizing a sloped filter 30 extending across the sump enclosure 50, as depicted in FIGS. 1–6, it is preferred that the standpipe 100 be disposed at location proximate to a lowermost region of the filter 30, which in the previously described dishwasher 1, is in the vicinity of the inner filter edge 38. By locating the filter standpipe 100 at or near the lowermost region of the filter 30, in the event the filter 30 becomes blocked or partially so and wash water begins to collect on the upper surface 32 of the filter 30, the standpipe 100 drains the standing wash water sooner than if the standpipe 100 (of equal height) were disposed at a higher location on the filter 30, such as proximate to the outer filter edge 36. The reference to the height of the filter standpipe 100 is actually with regard to the height of the upper distal edge of the standpipe 100 as measured from the upper surface 32 of the filter 30 over which, or the aperture defined in the standpipe 100 through which, wash water flows to bypass the filter 30 and flow into the sump enclosure 50.

The diameter of the filter standpipe is such that the standpipe can provide a flow rate at least as great as the demand of the circulation pump 86, which as previously noted is typically from about 12 to about 13 gallons per minute. For most applications, the inside diameter of the standpipe 100 is at least about ½ of an inch, and preferably at least about ¾ of an inch. The height of the standpipe 100 from the upper surface 32 of the filter is typically from about ¼ inch to about ½ inch.

Figure 7:
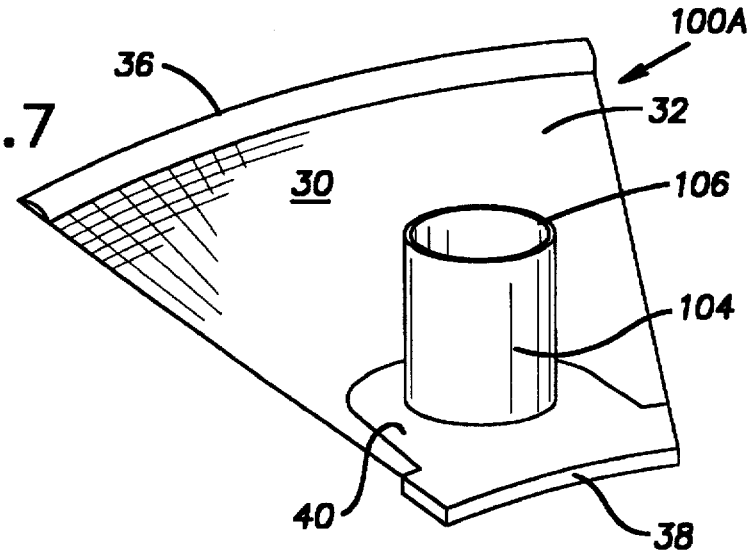
FIG. 7 is a detail of a first preferred embodiment filter standpipe.

FIG. 7 illustrates a perspective view of a portion of the filter 30 having a first preferred embodiment filter standpipe 100A disposed thereon. The filter standpipe 100A comprises a weir tube 104 projecting generally upward from the upper surface 32 of the filter 30. The tube 104 has an upper edge 106 and a second oppositely directed lower edge (not shown) disposed near the underside of the filter 30. The weir tube 104 is preferably mounted upon a filter standpipe support base 40 that is connected to or integrally formed with the inner filter edge 38.

Figure 8:
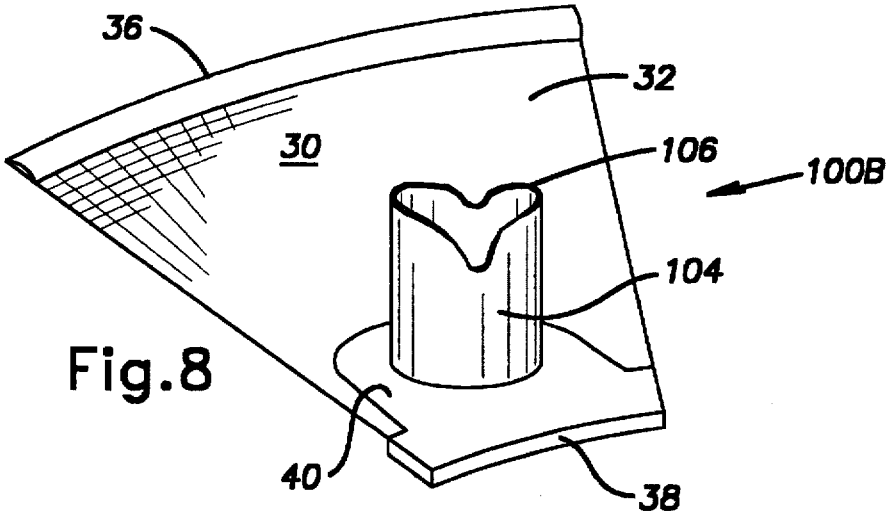
FIG. 8 is a detail of a second preferred embodiment filter standpipe.

FIG. 8 illustrates a second preferred embodiment filter standpipe 100B in accordance with the present invention. In this embodiment, the upper edge 106 of the weir tube 104 is irregular and may be curved or notched to provide an increased flow rate through the tube 104 as water level increases relative to the height of the notched edge 106. Thus, as the degree of filter blockage increases and the level of wash water disposed on the upper surface 32 of the filter 30 increases, the flow of wash water through the tube 104 can increase with increasing wash water level.

The notched edge 106 may be straight, angled, arcuate, or any other configuration as desired. Thus, this upper edge could be angled in that when the standpipe is viewed from its side, the edge extends at some angle other than 90° with respect to the longitudinal axis of the stand pipe. The angled edge could be such that it has a jagged or serrated profile, or define a plurality of rectangular upwardly extending sections, each separated by a U-shaped, V-shaped, or other variant form of a depression. The upper edge could be arcuate so that it has a varying curvature at different regions along the perimeter of the standpipe. Other edge configurations are contemplated including combinations of one or more edge sections that are straight, angled, arcuate, or of other geometry.

Figure 9:
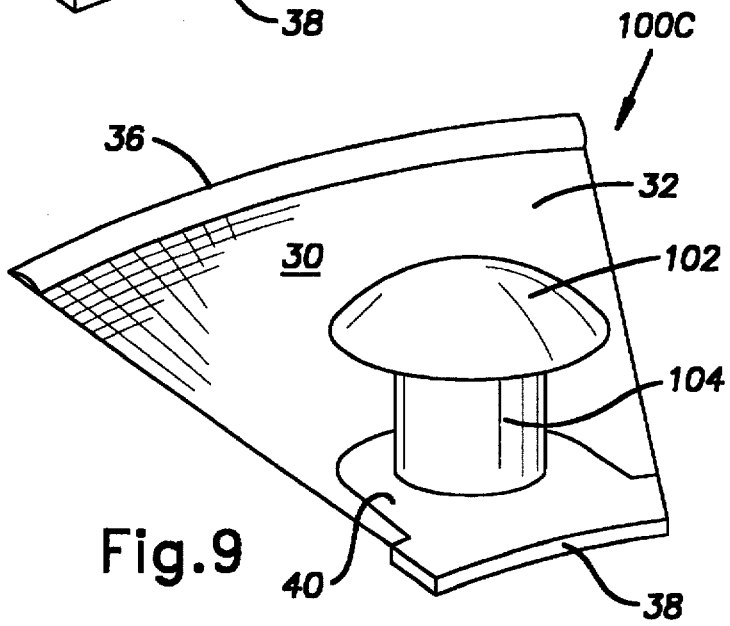
FIG. 9 is a detail of a third preferred embodiment filter standpipe.

FIG. 9 illustrates a third preferred embodiment filter standpipe 100C utilizing an optional bell cap 102 disposed over the upper edge 106 and opening of the weir tube 104. The bell cap 102 overlies the tube 104 and edge 106 yet allows entry of wash water underneath and into the weir tube 104.

In addition to the foregoing, the present invention also provides methods for preventing loss of circulation pump prime in a dishwasher by use of the previously described filter standpipe. Methods are also contemplated in which blocked filter conditions are remedied or corrected by use of the filter standpipe. That is, a filter standpipe could be selectively operated in the event of a blocked filter condition. Activation or opening of the filter standpipe could be accomplished either manually or automatically, whereby wash water having accumulated on one side of a blocked filter would travel through the filter standpipe to the other side of the filter.

The present invention encompasses a wide array of sump unit configurations or combinations of pumps and filters. Thus, the present invention can be utilized in conjunction with nearly any type of filter besides the flat screen type described herein. For instance, the present invention standpipe could be employed with a cartridge type filter. The essence of the invention is providing a standpipe or other flow-enabling conduit in the sump or dishwasher tub and in parallel with the filter such that in the event of a blocked filter condition, flow to the pump is maintained.

While the foregoing details are what is felt to be the preferred embodiments of the present invention, no material limitations to the scope of the claimed invention are intended. Further, features and design alternatives that would be obvious to one of ordinary skill in the art are considered to be incorporated herein. The scope of the invention is set forth and particularly described in the claims herein below.

What is claimed is:

1. A dishwasher tub and sump assembly comprising:

a tub adapted for retaining articles to be washed therein;

a sump container in fluid communication with said tub;

a circulation pump having a pump inlet in fluid communication with at least one of said tub and said sump container and a pump outlet in fluid communication with said tub;

a filter disposed in a flow path extending between said pump inlet and at least one of said tub and said sump container, wherein said filter is annular-shaped and provides an outer circular filter edge and an inner circular filter edge, said outer circular edge disposed above said inner circular edge; and a filter standpipe disposed in said flow path parallel to said filter, wherein said filter standpipe is disposed at or proximate to said inner circular filter edge, said standpipe having a distal end defining an inlet opening, said distal end disposed at a height approximately the same as said outer circular edge of said filter.

2. The dishwasher sump unit of claim 1 wherein said filter provides a filtering layer extending across said flow path, and said filter standpipe extends through said layer.

3. A dishwasher sump unit comprising:

a sump enclosure providing an interior cavity for receiving and storing wash water, said enclosure having a lower region and an upper region, wherein said upper region defines an opening to access said interior cavity of said enclosure, said enclosure comprising a bottom wall;

a filter extending across said opening defined in said upper region of said enclosure, said filter having a first face and a second oppositely directed face, said second face directed toward said lower region of said enclosure, wherein said filter is annular-shaped and provides an outer circular filter edge and an inner circular filter edge, said outer circular filter edge being disposed from said bottom wall of said enclosure a distance that is greater than the distance between said inner circular filter edge and said bottom wall of said enclosure;

and a filter standpipe having a first end disposed proximate to said first face of said filter, and a second end disposed proximate to said second face of said filter, wherein the first end defines an inlet opening, said filter standpipe is disposed proximate to said inner circular filter edge and said first end of said filter standpipe is disposed at approximately the same distance from said bottom wall as said outer circular edge.

4. The dishwasher sump unit of claim 3 further comprising:

a circulation pump having a pump inlet in fluid communication with said lower region of said enclosure, and a pump outlet.

5. The dishwasher sump unit of claim 4 further comprising:

a rotatable spray arm in fluid communication with said pump outlet, said spray arm disposed above said filter and proximate to said first face of said filter.

6. The dishwasher sump unit of claim 3 wherein said filter standpipe further comprises a bell cap disposed over said first end of said standpipe.

7. The dishwasher sump unit of claim 3 wherein said filter standpipe is cylindrical and has an inside diameter of at least about ½ inch.

8. The dishwasher sump unit of claim 7 wherein said inside diameter of said filter standpipe is at least about 3/4 inch.

9. The dishwasher sump unit of claim 3 wherein said first end of said filter standpipe is disposed above said first face of said filter a distance of from about ¼ inch to about ½ inch.

10. A dishwasher comprising:

A housing that provides an interior chamber for washing wares disposed in said chamber;

a door pivotally attached to said housing;

a sump unit disposed within said chamber, said sump unit having (i) a sump enclosure defining an interior cavity for receiving and storing wash water, said enclosure defining an upper region and a lower region, said upper region providing an opening to access said interior cavity of said enclosure, (ii) an annular-shaped filter extending across said opening provided in said upper region of said enclosure, said filter providing an outer circular edge and an inner circular edge disposed below said outer edge, (iii) a circulation pump having a pump inlet in fluid communication with said lower region of said enclosure, and a pump outlet, and (iv) a rotatable spray arm in fluid communication with said pump outlet, said spray arm disposed above said filter; and a filter standpipe having a first end disposed at a height approximately the same as said outer edge of said filter, and a second end disposed below said filter, said filter standpipe disposed proximate said inner edge of said filter.

11. The dishwasher sump unit of claim 10 wherein said first end of said filter standpipe defines an edge having a notch to provide increased flow through the standpipe as liquid level rises relative to the standpipe.

12. The dishwasher sump unit of claim 10 wherein said filter standpipe further comprises a bell cap disposed over said first end of said standpipe.

13. A method of operating a washer having a tub adapted for retaining articles to be washed therein; a sump container in fluid communication with said tub; a circulation pump having a pump inlet in fluid communication with at least one of said tub and said sump container and a pump outlet in fluid communication with said tub; an annular-shaped filter disposed in a flow path extending between said pump inlet and at least one of said tub and said sump container, said filter providing an outer circular edge and an inner circular edge disposed below said outer edge; and a filter standpipe disposed proximate said inner edge of said filter and further disposed in said flow path parallel to said filter and having an inlet upstream of said filter, said inlet disposed at a height approximately the same as said outer edge of said filter, said method comprising the steps of:

filling liquid into the sump;

applying the liquid on the articles in the tub;

returning the liquid to the sump by flow of the liquid through the filter; and returning the liquid to the sump by flow of the liquid through the standpipe when blockage of the filter causes a level of the liquid to rise above the filter to the standpipe inlet.

* * * * *